US010058978B2

(12) United States Patent
Sato et al.

(10) Patent No.: US 10,058,978 B2
(45) Date of Patent: Aug. 28, 2018

(54) NOZZLE DEVICE

(71) Applicant: SUGINO MACHINE LIMITED, Uozu, Toyama Prefecture (JP)

(72) Inventors: Sho Sato, Uozu (JP); Sachie Ejiri, Uozu (JP)

(73) Assignee: SUGINO MACHINE LIMITED, Uozu, Toyama Prefecture (JP)

( * ) Notice: Subject to any disclaimer, the term of this patent is extended or adjusted under 35 U.S.C. 154(b) by 38 days.

(21) Appl. No.: 15/484,350

(22) Filed: Apr. 11, 2017

(65) Prior Publication Data

US 2017/0326706 A1 Nov. 16, 2017

(30) Foreign Application Priority Data

May 11, 2016 (JP) ..... 2016-095230

(51) Int. Cl.
*B24C 5/00* (2006.01)
*B24C 5/04* (2006.01)

(52) U.S. Cl.
CPC ..... *B24C 5/04* (2013.01)

(58) Field of Classification Search
CPC ..... B24C 7/0084; B24C 7/0046; B24C 1/045
USPC ..... 451/35–39, 102
See application file for complete search history.

(56) References Cited

U.S. PATENT DOCUMENTS 3,972,150 A * 8/1976 Hart ..... B24C 3/02 239/314
4,522,597 A * 6/1985 Gallant ..... A61C 3/025 433/216
4,555,872 A * 12/1985 Yie ..... B05B 7/1431 451/102
5,325,638 A * 7/1994 Lynn ..... B24C 7/0053 451/39
5,423,713 A * 6/1995 Mishima ..... B24C 1/04 451/102
5,643,058 A * 7/1997 Erichsen ..... B24C 1/045 451/100
5,876,267 A * 3/1999 Kanda ..... B24C 5/04 451/102
6,280,302 B1 * 8/2001 Hashish ..... B24C 5/04 451/102

(Continued)

FOREIGN PATENT DOCUMENTS

JP H2-311300 A 12/1990
JP H3-038163 U 4/1991

*Primary Examiner* — George Nguyen
(74) *Attorney, Agent, or Firm* — United IP Counselors, LLC

(57) ABSTRACT

A nozzle device produces a more convergent water jet to improve the quality of a cut surface. The nozzle device includes a liquid supply channel for supplying a liquid, an orifice for discharging the liquid supplied from the liquid supply channel to produce a water jet, a straightening unit arranged downstream of the water jet from the orifice and having a through-hole to surround the water jet, a first air supply channel for supplying a gas toward a location upstream of the water jet from the through-hole and toward the orifice, and a second air supply channel arranged downstream of the water jet from the first air supply channel for supplying the gas toward a location inside the through-hole or a location downstream of the water jet from the through-hole.

20 Claims, 6 Drawing Sheets

(56) References Cited

U.S. PATENT DOCUMENTS

| | | | | |
|---|---|---|---|---|
| 6,283,833 | B1 * | 9/2001 | Pao | B24C 5/04 451/102 |
| 6,464,570 | B1 * | 10/2002 | Shaw | B24C 1/04 451/102 |
| 8,210,908 | B2 | 7/2012 | Hashish | |
| 8,308,525 | B2 * | 11/2012 | Hashish | B24C 5/02 451/102 |
| 2001/0007808 | A1 * | 7/2001 | Mishima | B05B 7/1404 451/38 |
| 2004/0107810 | A1 * | 6/2004 | Sciulli | B24C 1/045 83/177 |
| 2005/0017091 | A1 | 1/2005 | Olsen et al. | |
| 2011/0086579 | A1 * | 4/2011 | Gelbart | B24C 1/045 451/40 |

* cited by examiner

NOZZLE DEVICE

CROSS-REFERENCE TO RELATED APPLICATIONS

This application claims the benefit of priority to Japanese Patent Application No. 2016-095230, filed on May 11, 2016, the entire contents of which are hereby incorporated by reference.

BACKGROUND

1. Technical Field

The present invention relates to a nozzle device that discharges a water jet or an abrasive water jet for machining a workpiece.

2. Description of the Background

Cutting machines known in the art may discharge a water jet, or a jet of ultrahigh-pressure water, onto the surface of a workpiece to cut the workpiece. A disturbed and unstable water jet from a cutting machine can lower the cutting performance, and possibly causes a rough cut surface, a lower machining speed, and an increased difficulty in cutting a thick workpiece.

To stabilize the jet stream of the ultrahigh-pressure water and increase convergence, an ultrahigh-pressure discharge nozzle known in the art uses gas, such as air, supplied into the nozzle part. The gas surrounding the jet stream flows downstream together with and along the jet stream (refer to, for example, FIGS. 1, 3, 5, and 6 in Japanese Unexamined Patent Application Publication No. 2-311300, hereafter Patent Literature 1; FIGS. 1 and 2 in Japanese Unexamined Utility Model Application Publication No. 3-38163, hereafter Patent Literature 2; and FIGS. 4, 7 to 10 in U.S. Pat. No. 8,210,908, hereafter Patent Literature 3; and FIGS. 1 to 4 in U.S. Patent Application Publication No. 2005/0017091, hereafter Patent Literature 4).

The ultrahigh-pressure water discharge nozzle devices described in Patent Literatures 1 to 4 each include an air ejector, which ejects air from a nearby location toward a portion of the jet stream that has passed through the orifice to prevent the jet stream from hitting the orifice blade surface and from lowering the convergence.

BRIEF SUMMARY

The nozzle devices described in Patent Literatures 1 to 4 each include the air ejector that ejects air from the nearby location toward the portion of the jet stream that has passed through the orifice in the flow direction of the jet stream and along the axis of the jet stream to improve the convergence of the jet stream. To allow higher-quality cutting, the jet stream desirably has higher convergence.

One or more aspects of the present invention are directed to a nozzle device that produces a more convergent water jet to improve the quality of a cut surface.

A nozzle device according to one or more embodiments of the invention includes:

a liquid supply channel configured to supply a liquid;

an orifice configured to discharge the liquid supplied from the liquid supply channel to produce a water jet;

a straightening unit arranged downstream of the water jet from the orifice, the straightening unit having a through-hole configured to surround the water jet;

a first air supply channel configured to supply a gas toward a location upstream of the water jet from the through-hole and toward the orifice; and a second air supply channel arranged downstream of the water jet from the first air supply channel, and configured to supply the gas toward a location inside the through-hole or a location downstream of the water jet from the through-hole.

The nozzle device according to one or more embodiments of the present invention produces a more convergent water jet to improve the quality of a cut surface.

DETAILED DESCRIPTION

First Embodiment

Figure 1:
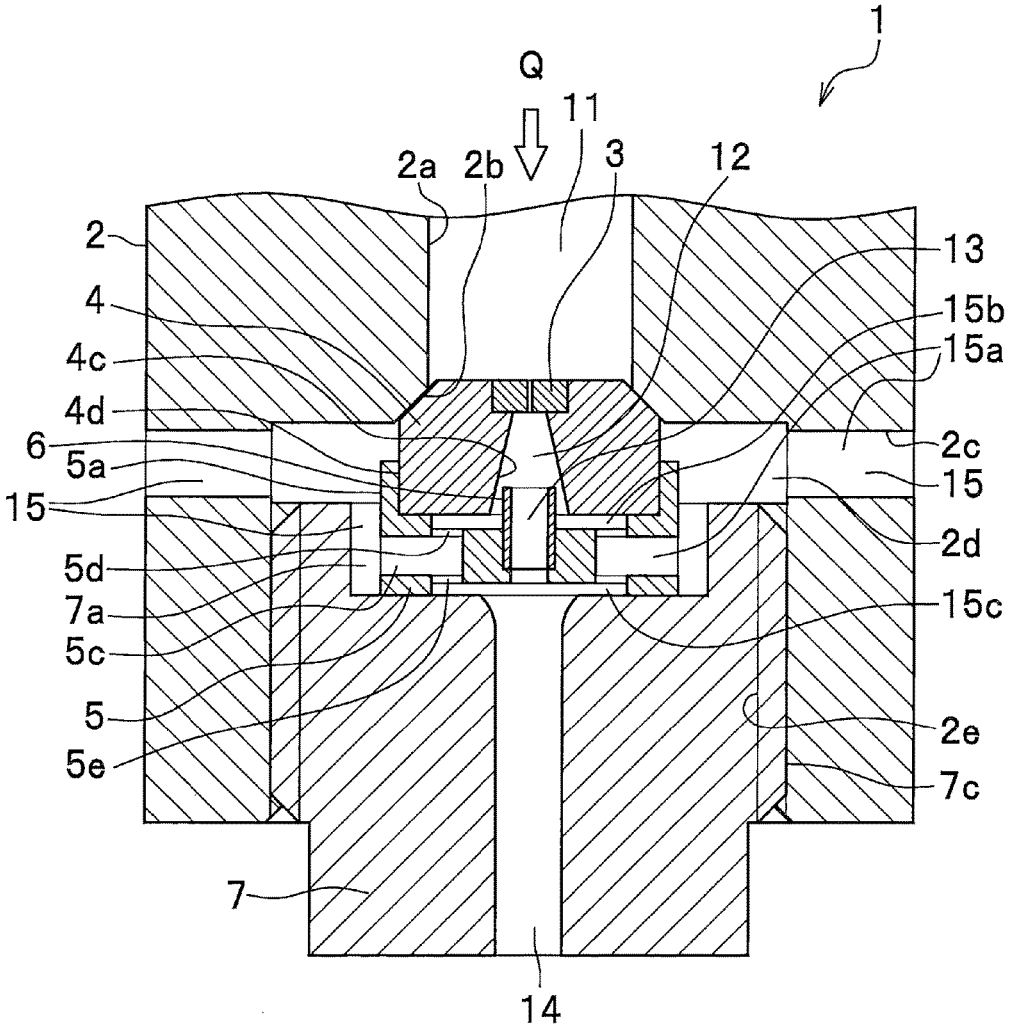
FIG. 1 is a schematic vertical cross-sectional view showing the main components of a nozzle device according to a first embodiment.
Figure 2:
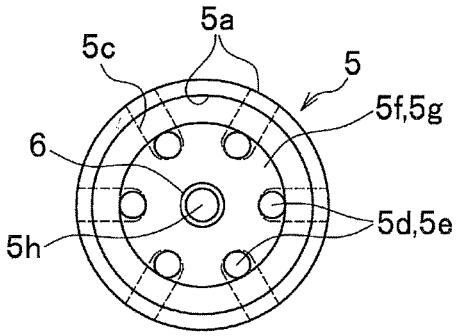
FIG. 2 is a schematic top view of a branch member according to the first embodiment.
Figure 3:
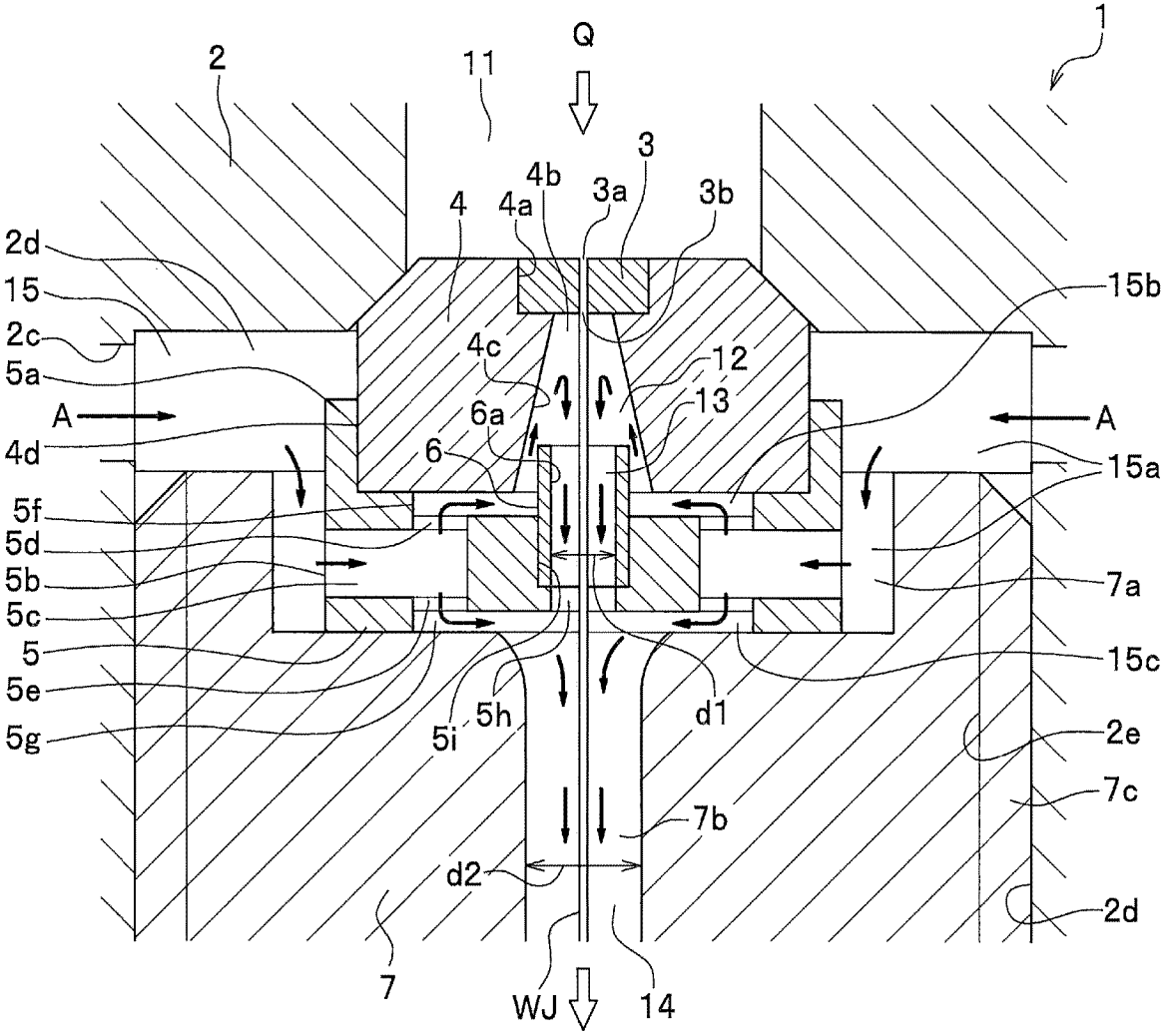
FIG. 3 is an enlarged view of a central portion of the nozzle device shown in FIG. 1.

Referring to FIGS. 1 to 3, a nozzle device according to a first embodiment will now be described. For descriptive purposes in the first and second embodiments, a liquid supply channel 11 in FIG. 1 is on the upper side (upstream), and a high-pressure fluid flow channel 14 in FIG. 1 is on the lower side (downstream).

Nozzle Device

A nozzle device 1 according to the first embodiment is a liquid discharge device included in a cutting machine. The nozzle device 1 shapes, through an orifice 3, a liquid Q, such as high-pressure water, into a water jet WJ, and discharges the water jet WJ onto a workpiece to cut the workpiece. The nozzle device 1 includes the orifice 3, an orifice support 4, a body 2, a branch member 5, a straightening tube 6, and a nozzle cap 7. The orifice support 4 supports the orifice 3. The body 2 contains the orifice support 4. The branch member 5 is arranged downstream from the orifice support 4. The straightening tube 6 is arranged upstream from a central portion of the branch member 5. The nozzle cap 7 holds the branch member 5 from downstream.

The nozzle device 1 has a flow channel including the liquid supply channel 11, a discharge channel 12, a flow-through channel 13, a high-pressure fluid flow channel 14, and an air supply channel 15. The liquid supply channel 11 is used to supply a liquid for machining a workpiece. The discharge channel 12 receives a water jet WJ discharged from the orifice 3, which is downstream from the liquid supply channel 11. The flow-through channel 13 is downstream from the discharge channel 12. The high-pressure fluid flow channel 14 is downstream from the flow-through channel 13. The air supply channel 15 is used to supply air A (gas) to the flow-through channel 13 and the high-pressure fluid flow channel 14.

Body

As shown in FIG. 1, the body 2 is a main part of the nozzle device. The body 2 contains the orifice support 4 and the nozzle cap 7. The body 2 defines a part of the liquid supply channel 11 and a part of the air supply channel 15. The body 2 includes a fluid supply cavity 2*a*, a mounting base support 2*b*, gas inlets 2*c*, and a nozzle cap housing 2*d*. The fluid supply cavity 2*a* is a part of the liquid supply channel 11. The mounting base support 2*b* is arranged at a lower end of the fluid supply cavity 2*a*. Each gas inlet 2*c* is a part of the air supply channel 15. The nozzle cap housing 2*d* is defined under the fluid supply cavity 2*a* to allow communication between the fluid supply cavity 2*a* and the gas inlets 2*c*.

The fluid supply cavity 2*a* receives the liquid Q supplied from a high-pressure water supply device (not shown) through a high-pressure pipe. The fluid supply cavity 2*a* extends from the upper end of a central portion of the body 2 downward.

The mounting base support 2*b* is in contact with the orifice support 4. The mounting base support 2*b*, which is beveled, is arranged at an intersection between the lower end of the fluid supply cavity 2*a* and an upper end portion of the nozzle cap housing 2*d*. The mounting base support 2*b* may not be beveled.

The gas inlets 2*c* allow the air A to be drawn from the atmosphere through them under negative pressure, which is generated when the water jet WJ is ejected from the orifice 3 and passes through the discharge channel 12 and the high-pressure fluid flow channel 14 at high speed. The body 2 includes at least one gas inlet 2*c*, which allows communication between the external atmosphere and the nozzle cap housing 2*d*. In the present embodiment, the body 2 includes a plurality of gas inlets, which each extend from the outer circumferential surface of the body 2 toward an upper end of the nozzle cap housing 2*d*.

Each gas inlet 2*c* may receive air A supplied from an air supply device.

The nozzle cap housing 2*d* is a cavity for containing the nozzle cap 7, the branch member 5 arranged on the nozzle cap 7, and the orifice support 4. The nozzle cap housing 2*d* extends from the lower end of a central portion of the body 2 to the lower end of the fluid supply cavity 2*a*.

Orifice

The orifice 3 is a nozzle tip, which is substantially a thick plate. The orifice 3 has an opening with a diameter smaller than the cross-sectional area of the liquid supply channel 11, and ejects the liquid Q from the opening to produce the water jet WJ. The orifice 3 is formed from, for example, diamond or sapphire. The orifice 3 includes an inlet hole 3*a*, through which the liquid Q is supplied from the liquid supply channel 11, and an outlet hole 3*b*, through which the liquid Q is discharged. The orifice 3 is held on the upper end of a central portion of the orifice support 4.

The inlet hole 3*a* has an inner diameter of, for example, about 0.1 to 1 mm.

The outlet hole 3*b* extends from the inlet hole 3*a* to the lower end of the orifice 3. The outlet hole 3*b* is an exit of the flow channel.

Orifice Support

As shown in FIG. 3, the orifice support 4, which is a base for mounting the orifice, supports the orifice 3. The orifice support 4 includes an orifice holding portion 4*a* and a jet discharge hole 4*b*. The orifice holding portion 4*a* holds the orifice 3. The jet discharge hole 4*b* is defined under the orifice holding portion 4*a*.

The orifice 3 is fitted in the orifice holding portion 4*a*. The orifice holding portion 4*a* is a stepwise recess on the upper end of a central portion of the jet discharge hole 4*b*.

The upper end of the jet discharge hole 4*b* has an inner diameter greater than the inner diameter of the outlet hole 3*b*. The jet discharge hole 4*b* is a channel with a circular truncated cone shape, which has a diameter increasing downstream.

The jet discharge hole 4*b* has an inner circumferential surface 4*c* with an appropriate sloping angle set in accordance with the size of the inlet hole 3*a* and the size of the outlet hole 3*b*.

The jet discharge hole 4*b* may not have a circular truncated cone shape, and may be cylindrical or domical.

In the present embodiment, the orifice support 4 includes no air supply channel. The orifice support 4 is thus rigid, and can hold the orifice 3 securely. The orifice 3 can thus produce a stable water jet WJ with higher convergence.

Branch Member

The branch member 5 splits the flow of the air A (gas) supplied from the air supply channel 15 into a first air supply channel 15*b* and a second air supply channel 15*c*, which supply the air A toward the water jet WJ. The branch member 5 includes a fitting portion 5*a*, gas inlet holes 5*b*, lateral holes 5*c*, vertical holes 5*d* and 5*e*, lateral grooves 5*f* and 5*g*, a through-hole 5*h*, and a straightening tube holder 5*i*. The high-pressure fluid flow channel 14 and the nozzle cap 7 are arranged downstream from the branch member 5. The high-pressure fluid flow channel 14 has an inner diameter d2 greater than the inner diameter d1 of the straightening tube 6. The nozzle cap 7 supports the branch member 5.

The fitting portion 5*a* receives a downstream peripheral portion 4*d* of the orifice support 4, which is fitted in the fitting portion 5*a*. The fitting portion 5*a* protrudes upward (upstream) from the upper end of the outer circumference of the branch member 5. The fitting portion 5*a* is annular as viewed from above (refer to FIG. 2).

The gas inlet holes 5*b* are formed on the circumferential side surface of the branch member 5. Each gas inlet hole 5*b* is an opening through which the air A is drawn from an annular space defined by the branch member 5 and the inner wall of the branch member housing 7*a* in the nozzle cap 7 into the lateral holes 5*c* (refer to FIG. 2).

As shown in FIG. 2, the lateral holes 5*c* extend laterally from the gas inlet holes 5*b* toward the vertical holes 5*d* and 5*e*. The lateral holes 5*c* are radially spaced from one another. Each lateral hole 5*c* splits the air A into the corresponding upper and lower vertical holes 5*d* and 5*e*.

As shown in FIG. 3, the vertical holes 5*d* are branching holes that extend upward from the corresponding lateral holes 5*c*. The vertical holes 5*e* are branching holes that extend downward from the corresponding lateral holes 5*c*. The vertical holes 5*d* communicate with the first air supply channel 15*b*, which directs the air A flowing into the lateral holes 5*c* to flow into the air supply channel 15 in the direction of the discharge channel 12 (upstream). The vertical holes 5*e* communicate with the second air supply channel 15*c*, which directs the air A flowing into the lateral holes 5*c* to flow in the direction of the high-pressure fluid flow channel 14 (downstream).

The branch member 5 efficiently splits the air A into the first air supply channel 15*b* and the second air supply channel 15*c*. The branch member 5 uses no pipe or joints, and thus can reduce the number of parts and the assembling hours and reduce costs.

As shown in FIG. 2, the vertical holes 5*d* and 5*e* are arranged circumferentially about the through-hole 5*h* at equal intervals. For example, the nozzle device 1 has at least two sets of vertical holes 5*d* and 5*e* and lateral holes 5*c* as appropriate for the size or other specifications of the nozzle device 1. In the present embodiment, six sets of vertical holes 5*d* and 5*e* and lateral holes 5*c* are arranged circumferentially about the through-hole 5*h* at equal intervals in a manner to have the facing sets of holes.

As shown in FIGS. 2 and 3, the lateral groove 5*f* for the first air supply channel 15*b* is formed on the top surface of the branch member 5. The lateral groove 5*f* is a circular recess containing the open ends of the six vertical holes 5*d*. The lateral groove 5*f* has its downstream portion communicating with the lateral holes 5*c* via the vertical holes 5*d*, and has its upstream portion communicating with the discharge channel 12.

The lateral groove 5*g* for the second air supply channel 15*c* is continuously formed on the bottom surface of the branch member 5. The lateral groove 5*g* is a circular (annular) recess containing the open ends of the six vertical holes 5*e*. As shown in FIG. 3, the lateral groove 5*g* has its upstream circumferential portion communicating with the lateral holes 5*c* via the vertical holes 5*e*, and has its upstream central portion communicating with the through-hole 5*h*, and has its downstream portion communicating with the high-pressure fluid flow channel 14.

The through-hole 5*h* at the center of the branch member 5 extends along the axis of the jet stream. The straightening tube holder 5*i* for holding the straightening tube 6 is arranged upstream from the through-hole 5*h*. The through-hole 5*h* and the straightening tube 6 define the flow-through channel 13, in which the water jet WJ flows.

The straightening tube 6 has its lower portion fitted in the straightening tube holder 5*i*. The straightening tube holder 5*i* is a stepwise portion upstream from the through-hole 5*h*, and has a diameter expanded by the thickness of the straightening tube 6. The downstream small diameter portion of the straightening tube holder 5*i* has the same inner diameter as the straightening tube 6. The straightening tube holder 5*i* may not be a stepwise portion but may be any portion that can hold the straightening tube 6.

Straightening Tube

The straightening tube 6 (straightening unit) is a cylindrical tube, which is an ejector. The ejector herein discharges the air A along the water jet WJ while straightening and accelerating the air A. The straightening tube 6 has a downstream portion fitted in the straightening tube holder 5*i* in the branch member 5, and has an upstream portion protruding from the lateral groove 5*f* into the channel defined by the inner circumferential surface 4*c*. The straightening tube 6 has its upstream open end arranged downstream from the orifice 3 via the discharge channel 12.

The straightening tube 6 may be integral with the branch member 5.

The straightening tube 6 restricts the flow direction of the gas in the first air supply channel 15*b* to efficiently supply the gas to immediately below the outlet hole. The straightening tube 6 has its upstream portion arranged adjacent to the inner circumferential surface 4*c* to allow the converging water jet WJ to flow into the straightening tube 6.

Nozzle Cap

As shown in FIG. 1, the nozzle cap 7 is housed in the nozzle cap housing 2*d* under the orifice support 4 and the branch member 5. As shown in FIG. 3, the nozzle cap 7 includes a branch member housing 7*a*, a jet discharge outlet 7*b*, and an external thread 7*c*. The branch member housing 7*a* contains the branch member 5. The jet discharge outlet 7*b* allows the water jet WJ to be discharged through it. The external thread 7*c* is screwed with an internal thread 2*e* formed on the nozzle cap housing 2*d*. The nozzle cap 7 is arranged in the nozzle cap housing 2*d* under the air supply channel 15, which is arranged at the upper end of the nozzle cap housing 2*d*.

The branch member housing 7*a* is a circular recess formed on a central portion of the top surface of the nozzle cap 7. The branch member housing 7*a* has an inner diameter greater than the outer diameter of the branch member 5 as viewed from above.

The jet discharge outlet 7*b*, which is a part of the high-pressure fluid flow channel 14, extends downstream along the axis of the jet stream from a central portion of the inner bottom surface of the branch member housing 7*a*. The jet discharge outlet 7*b* has its upstream end portion with a diameter increasing upstream.

Liquid Supply Channel

The liquid supply channel 11 receives the liquid Q supplied from a high-pressure water supply device (not shown) through a high-pressure pipe. The liquid supply channel 11 extends downward from an upper end central portion of the body 2.

Discharge Channel

As shown in FIG. 3, the water jet WJ discharged from the orifice 3 passes through the discharge channel 12. The discharge channel 12 includes the inlet hole 3*a* and the outlet hole 3*b* of the orifice 3, and the jet discharge hole 4*b* arranged in this order.

Flow-Through Channel

The flow-through channel 13 is defined by the inner wall of the straightening tube 6, and communicates with the through-hole 5*h*. The inner diameter of the flow-through channel 13 is equal to the inner diameter of the small portion of the jet discharge hole 4*b*, and is smaller than the inner diameter of the jet discharge outlet 7*b*. Unlike when the gas is directly released from the through-hole 5*h*, this structure reduces the diffusion of the gas flowing from the through-hole 5*h* along the water jet WJ and thus allows the water jet WJ to converge.

High-Pressure Fluid Flow Channel

The high-pressure fluid flow channel 14 is downstream from the intersection between the flow-through channel 13 and the second air supply channel 15*c* extending through the lateral groove 5*g*. The water jet WJ discharged from the high-pressure fluid flow channel 14 is used to machine a workpiece (not shown).

Air Supply Channel

As shown in FIG. 1, the air supply channel 15 includes a gas introduction channel 15*a*, the first air supply channel 15*b*, and the second air supply channel 15*c*. The air A is drawn from the atmosphere into the gas introduction channel 15*a*. The first air supply channel 15*b* supplies the air A into the discharge channel 12. The second air supply channel 15*c* supplies the air A downstream from the first air supply channel 15*b* and downstream from the straightening tube 6. The air supply channel 15 also includes the lateral holes 5*c* and the vertical holes 5*d* and 5*e* of the branch member 5.

The gas introduction channel 15*a* feeds the air A supplied from the outside of the nozzle device 1 to the lateral holes 5*c* through the body 2. The gas introduction channel 15*a* includes the gas inlets 2*c*, the nozzle cap housing 2*d*, the branch member housing 7*a*, and the lateral holes 5*c*.

As shown in FIG. 3, the first air supply channel 15*b* is a branch line extending from the lateral holes 5*c* to the upstream discharge channel 12. The first air supply channel 15*b* extends through the vertical holes 5*d*, the lateral grooves 5*f*, and along the outer circumferential surface portion of the straightening tube 6 toward the discharge channel 12, which is upstream from the straightening tube 6.

The second air supply channel 15*c* is a branch line extending from the lateral holes 5*c* to the downstream high-pressure fluid flow channel 14. The second air supply channel 15*c* extends through the vertical holes 5*e* and the lateral grooves 5*g* toward the high-pressure fluid flow channel 14, which is downstream from the through-hole 5*h*.

Advantages of First Embodiment

Referring now to FIGS. 1 to 3, the advantages of the nozzle device according to the first embodiment will be described with reference to the relevant processing steps.

A workpiece is first set on a holder (not shown) under the nozzle device 1 shown in FIG. 1. A pump (not shown) for supplying a liquid Q (high-pressure water) and a high-pressure water supply device are then activated to supply the liquid Q onto the liquid supply channel 11.

As shown in FIG. 3, the liquid Q supplied onto the liquid supply channel 11 is shaped into the water jet WJ with an accelerated flow rate as it passes through the orifice 3. The water jet WJ is then discharged from the outlet hole 3*b*. The discharged water jet WJ flows through the discharge channel 12, the flow-through channel 13, and the high-pressure fluid flow channel 14, and is then discharged from the jet discharge hole toward the workpiece.

The air A is drawn from the atmosphere into the air supply channel 15 through the supply port of the gas inlet 2*c* under the negative pressure that is generated by the water jet WJ, and flows through the discharge channel 12, the flow-through channel 13, and the high-pressure fluid flow channel 14. The air A drawn into the air supply channel 15 also flows through the space defined at the upper end of the nozzle cap housing 2*d*, the branch member housing 7*a*, and the gas inlet holes 5*b* and flows into the six lateral holes 5*c*, which are arranged radially (refer to FIG. 2).

The air A flowing into the upstream vertical holes 5*d* (the first air supply channel 15*b*) from the lateral holes 5*c* passes through the lateral groove 5*f*, and passes between the straightening tube 6 and the inner circumferential surface 4*c* toward the lower surface of the orifice 3. In other words, the first air supply channel 15*b* can feed the air A to near the outlet hole 3*b*. This structure reduces the energy of the vortical field of the gas generated at the lower surface of the orifice. The gas from the first air supply channel 15*b* reduces the disturbance of the water jet WJ and allows the water jet WJ to converge effectively. Further, the sloping inner circumferential surface 4*c* guides the gas supplied from the first air supply channel 15*b* to the discharge channel to flow toward the outlet hole of the orifice 3.

The air A flowing toward the orifice 3 meets the water jet WJ discharged from the outlet hole 3*b* and changes its direction, and flows along the water jet WJ (from upstream to downstream) in a manner to surround the water jet WJ. In this manner, the first air supply channel 15*b* reduces the difference in the relative flow rate between the air A and the water jet WJ immediately after the water jet WJ is discharged from the orifice 3. This structure reduces the disturbance of the water jet WJ immediately after the water jet WJ is discharged from the outlet hole 3*b*, and stabilizes the water jet WJ. The six vertical holes 5*d* arranged circumferentially at equal intervals allow the air A to flow in streams spaced at circumferentially equal intervals toward the water jet WJ. This allows the air resistance against the water jet WJ to be uniform in the circumferential direction and improves the convergence of the water jet WJ. The air A in the discharge channel 12 is drawn into the straightening tube 6 by the ejector effect, and flows downstream while being accelerated. This prevents the water jet WJ from diffusing under the negative pressure in the discharge channel 12 generated by the high-speed water jet WJ. The air A causes the water jet WJ to flow downstream while converging uniformly.

The air A flowing from the six lateral holes 5*c* toward the downstream vertical holes 5*e* (the second air supply channel 15*c*) passes through the lateral groove 5*g* and flows into the high-pressure fluid flow channel 14. The air A uniformly surrounds the water jet WJ along the axis of the jet stream. At the exit of the flow-through channel 13, the accelerated air stream in the straightening tube 6 forms a second ejector. As a result, the air A in the second air supply channel 15*c* is drawn into the high-pressure fluid flow channel 14 to discharge the water jet WJ from the exit of the high-pressure fluid flow channel 14 together with the air A. In this state, the air A flowing through the second air supply channel 15*c* surrounds the water jet WJ. This structure prevents the water jet WJ from diffusing under the negative pressure and decelerating, and causes the air resistance at the outer circumferential surface to be uniform. This allows the water jet WJ to converge appropriately and to flow downstream in a stable manner. Further, the second air supply channel 15*c* can supply additional gas at the exit of the gas that flows through the through-hole along the water jet. This prevents the gas from flowing apart from the water jet, and thus improves the convergence of the water jet further.

The water jet WJ discharged from the high-pressure fluid flow channel 14 converges uniformly as being guided by the air A. The water jet WJ is thus highly convergent and stable. This water jet WJ can be used to machine a workpiece to have high quality cut surfaces with high machining accuracy.

The nozzle device 1 with this structure can cut thicker workpieces than those machined by nozzle devices known in the art, without changing the feeding speed.

After the cutting process of the workpiece, the pump and the high-pressure water supply device are stopped, and the machined workpiece is removed from the holder. This completes the machining operation.

Second Embodiment

A second embodiment will now be described with reference to FIGS. 4 to 6. The components described above are given the same reference numerals and will not be described.

Figure 4:
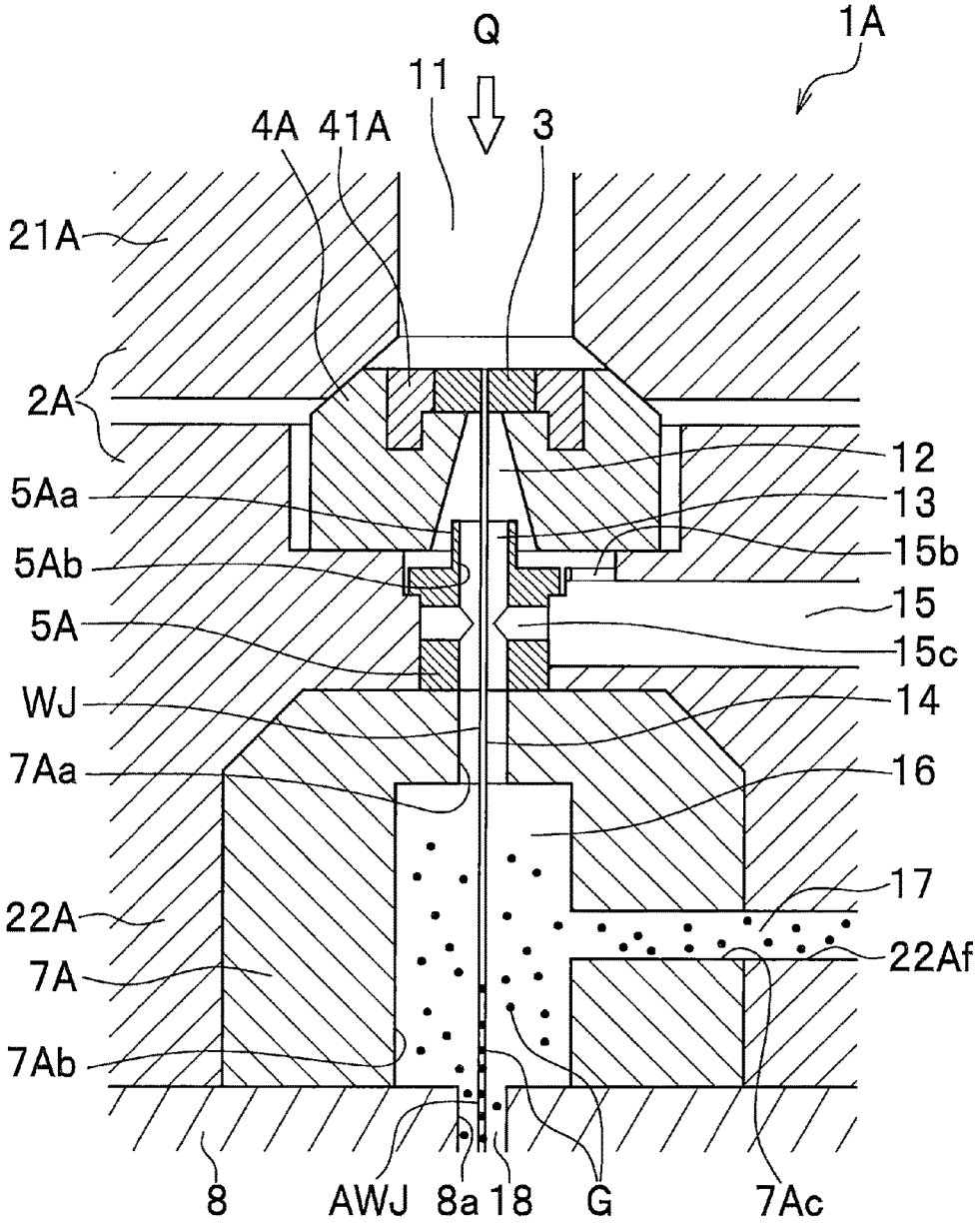
FIG. 4 is a schematic vertical cross-sectional view showing the main components of a nozzle device according to a second embodiment.

FIG. 4 is a schematic vertical cross-sectional view showing the main components of a nozzle device according to the second embodiment. FIG. 5 is a schematic top view of a branch member according to the second embodiment. FIG. 6 is an enlarged view of a central portion of the nozzle device shown in FIG. 4.

As shown in FIG. 4, a nozzle device 1A according to the present embodiment includes an abrasive supply chamber 16 downstream from a high-pressure fluid flow channel 14. The abrasive supply chamber 16 is used to generate an abrasive water jet AWJ by adding an abrasive G into a water jet WJ that has passed through the high-pressure fluid flow channel 14. The nozzle device 1 according to the first embodiment may include the abrasive supply chamber 16.

The nozzle device 1A, which is an abrasive water jet nozzle, has a flow channel including a liquid supply channel 11, a discharge channel 12, a flow-through channel 13, the high-pressure fluid flow channel 14, an air supply channel 15, the abrasive supply chamber 16, an abrasive supply channel 17, and an abrasive nozzle flow channel 18. The liquid supply channel 11 receives a liquid Q. The discharge channel 12 receives a water jet WJ discharged from an orifice 3. The flow-through channel 13 is downstream from the discharge channel 12. The high-pressure fluid flow channel 14 is downstream from the flow-through channel 13. The air supply channel 15 is used to supply air A to the discharge channel 12 and the flow-through channel 13. The abrasive supply chamber 16 is downstream from the high-pressure fluid flow channel 14. The abrasive supply channel 17 is used to supply the abrasive G to the abrasive supply chamber 16. The water jet WJ and the abrasive G mix in the abrasive supply chamber 16 to produce an abrasive water jet AWJ, which is then discharged into the abrasive nozzle flow channel 18.

The nozzle device 1A also includes the orifice 3, an orifice support 4A, a body 2A, a branch member 5A, a nozzle cap 7A, and an abrasive nozzle 8. The orifice support 4A supports the orifice 3. The body 2A contains the orifice support 4A and the branch member 5A. The branch member 5A, which includes a straightening tube 5Aa (straightening unit), is arranged downstream from the orifice support 4. The nozzle cap 7A defines the abrasive supply chamber 16, and holds the branch member 5 from downstream. The abrasive nozzle 8 is arranged downstream from the nozzle cap 7A.

Figure 6:
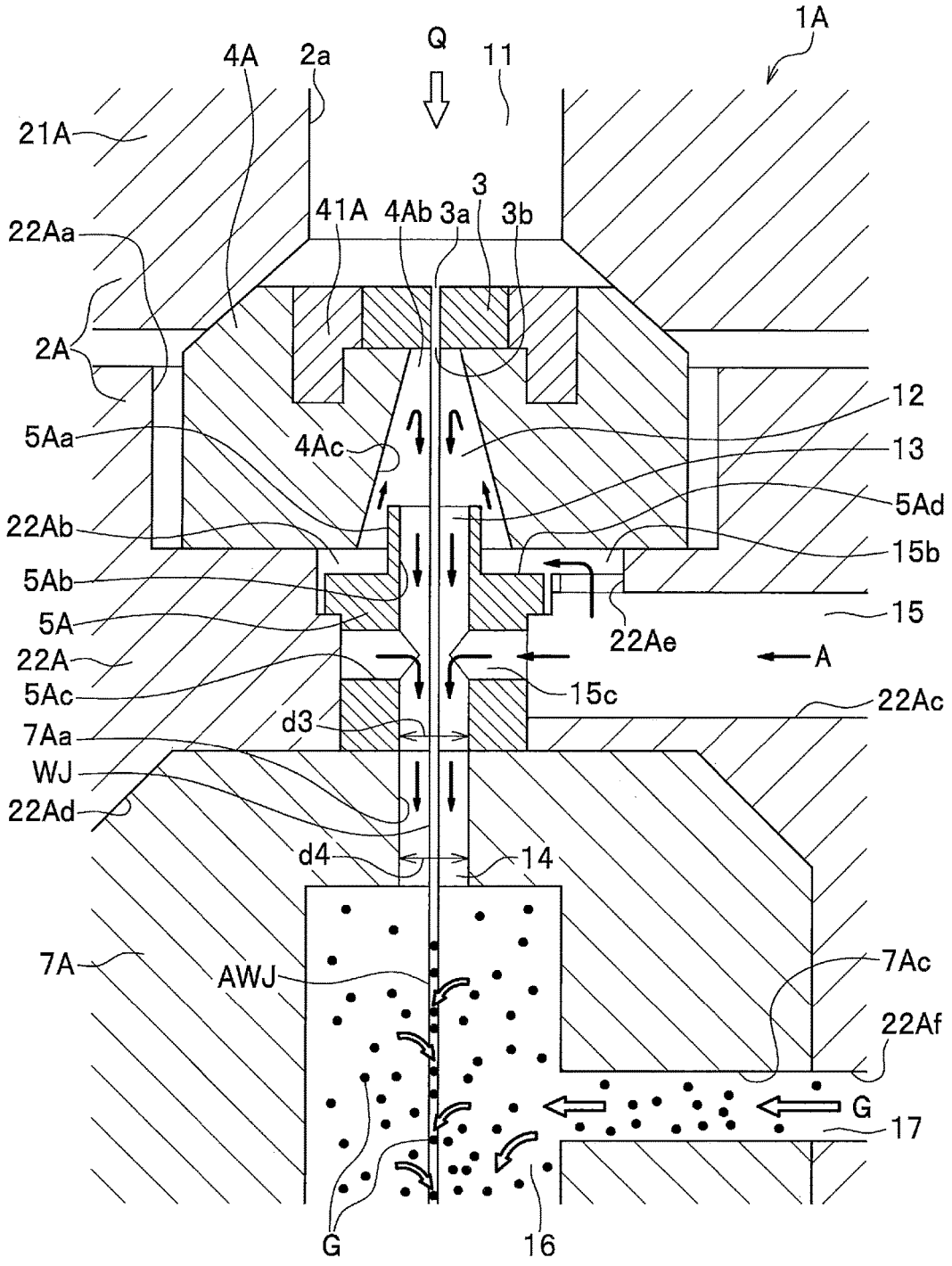
FIG. 6 is an enlarged view of a central portion of the nozzle device shown in FIG. 4.

As shown in FIG. 6, the orifice support 4A integrally holds the orifice holding member 41A. The orifice support 4A and the orifice 3 have the same outer shapes as those described in the first embodiment. In other words, the orifice support 4A includes a jet discharge hole 4Ab having a greater inner diameter than the outlet hole 3*b*, and has a sloping inner circumferential surface 4Ac defining the discharge channel 12.

The body 2A includes an upper body portion 21A and a lower body portion 22A. The upper body portion 21A holds the orifice support 4A from upstream. The lower body portion 22A holds the orifice support 4A, the branch member 5A, and the nozzle cap 7A.

The lower body portion 22A includes an orifice support member housing 22Aa, a branch member housing 22Ab, a nozzle cap housing 22Ad, a gas inlet 22Ac, a vertical hole 22Ae, and an abrasive supply cavity 22Af. The orifice support member housing 22Aa contains the orifice support 4A. The branch member housing 22Ab contains the branch member 5A. The nozzle cap housing 22Ad contains the nozzle cap 7A. Air A is supplied through the gas inlet 22Ac. The vertical hole 22Ae branches from the gas inlet 22Ac. The abrasive supply cavity 22Af is a part of the abrasive supply channel 17.

The straightening tube 5Aa is integral with the branch member 5A. In other words, the straightening tube 5Aa may have any shape that protrudes into the discharge channel 12 and has a through-hole 5Ab into which the water jet WJ and the air A flow from the discharge channel 12.

Like the branch member 5 according to the first embodiment, the branch member 5A branches the air supply channel 15 into the first air supply channel 15*b* and the second air supply channel 15*c* to supply the air A in two separate streams from upstream to downstream of the water jet WJ.

Figure 5:
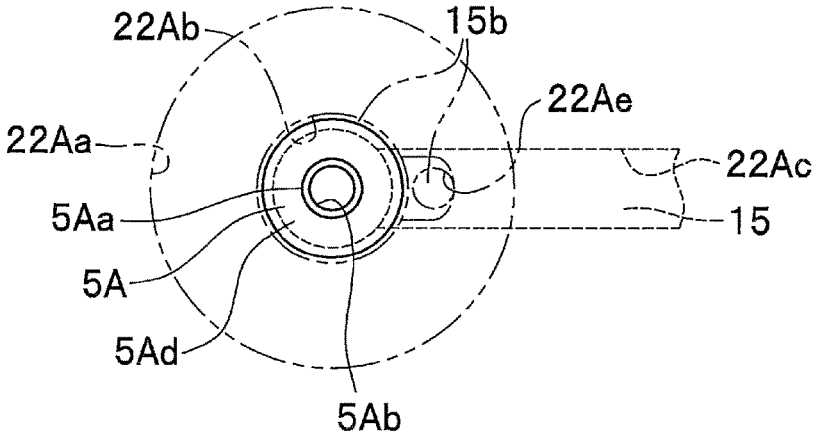
FIG. 5 is a schematic top view of a branch member according to the second embodiment.

As shown in FIGS. 5 and 6, the branch member 5A includes the straightening tube 5Aa, the through-hole 5Ab, a lateral hole 5Ac, and an upper outer circumferential surface 5Ad. The through-hole 5Ab extends from upstream to downstream to form the flow-through channel 13. The lateral hole 5Ac extends orthogonal to the through-hole 5Ab, and communicates with the gas inlet 22Ac (air supply channel 15). The upper outer circumferential surface 5Ad is a part of the first air supply channel 15*b*.

As shown in FIG. 4, the nozzle cap 7A includes a flow channel-defining cavity 7Aa, an abrasive supply chamber-defining cavity 7Ab, and an abrasive inlet hole 7Ac. The flow channel-defining cavity 7Aa is a high-pressure fluid flow channel 14 arranged downstream in communication with the through-hole 5Ab. The abrasive supply chamber-defining cavity 7Ab is an abrasive supply chamber 16 arranged downstream in communication with the flow channel-defining cavity 7Aa. The abrasive inlet hole 7Ac communicates with the abrasive supply cavity 22Af.

As shown in FIG. 6, the flow channel-defining cavity 7Aa (high-pressure fluid flow channel 14) has an inner diameter d4 equal to or greater than an inner diameter d3 of the through-hole 5Ab (flow-through channel 13).

The abrasive supply chamber-defining cavity 7Ab shown in FIG. 4 is a substantially cylindrical space. In the abrasive supply chamber-defining cavity 7Ab, the water jet WJ ejected from the orifice 3 draws the abrasive G from the abrasive inlet hole 7Ac when passing downstream through a central portion of the abrasive supply chamber 16. This produces the abrasive water jet AWJ.

The abrasive G shown in FIG. 4 is, for example, in the form of angular-shaped abrasive grains with sharp edges. The abrasive G is supplied into the abrasive supply chamber 16 from an abrasive supply device (not shown) through the abrasive supply channel 17.

The abrasive nozzle 8 has a nozzle cavity 8*a* defining an abrasive nozzle flow channel 18, which communicates with the abrasive supply chamber-defining cavity 7Ab.

Advantages of Second Embodiment

Referring now to FIGS. 4 to 6, the advantages of the nozzle device according to the second embodiment will be described.

As shown in FIG. 6, as in the first embodiment, the air A is drawn from the gas inlet 22Ac under the negative pressure that is generated by the water jet WJ ejected from the orifice 3, and flows into the discharge channel 12 and the flow-through channel 13. The air A drawn from the gas inlet 22Ac branches from the air supply channel 15 into the first air supply channel 15*b* and the second air supply channel 15*c*, and flows into the discharge channel 12 and the flow-through channel 13.

As in the first embodiment, the air A passing through the first air supply channel 15*b* flows upstream from the gas inlet 22Ac through the vertical hole 22Ae, and the upper outer circumferential surface 5Ad of the branch member 5A, flows obliquely upstream along the inner circumferential surface 4Ac toward the upstream outlet hole 3*b*, and flows into the discharge channel 12. The air A flowing toward the orifice 3 meets the water jet WJ discharged from the outlet hole 3*b* and changes its direction, and flows along the water jet WJ (from upstream to downstream) in a manner to surround the water jet WJ. The first air supply channel 15*b* reduces the difference in the relative flow rate between the air A and the water jet WJ immediately after the water jet WJ is discharged from the orifice 3. This structure reduces the disturbance of the water jet WJ immediately after the water jet WJ is discharged from the outlet hole 3*b*, and stabilizes the water jet WJ.

In the second air supply channel 15*c*, the air A flows into the flow-through channel 13 from the lateral hole 5Ac formed on the side surface of the branch member 5A toward the high-pressure fluid flow channel 14 (the flow channel-defining cavity 7Aa). The air A flows at high speed in the flow-through channel 13 in the discharge direction of the water jet WJ while the stream of the air A is surrounding the water jet WJ. This prevents the water jet WJ from being diffused by the reverse flow of the air A under the negative pressure, and allows the water jet WJ to converge.

In this manner, the air A from the first air supply channel 15*b* prevents the water jet WJ ejected from the orifice 3 from diffusing under the negative pressure in the discharge channel 12 immediately after the water jet WJ is discharged from the orifice 3. Further, the second air supply channel 15*c* can supply additional air A. The stream of the air A then surrounds the water jet WJ to maintain the high convergence of the water jet WJ for an extended time.

The water jet WJ surrounded by the air A passes through the high-pressure fluid flow channel 14 and flows into the abrasive supply chamber 16. The abrasive G is drawn from the abrasive inlet hole 7Ac and is added into the water jet WJ to produce the abrasive water jet AWJ.

The high-speed air A surrounding the water jet WJ reduces the negative pressure in the abrasive supply chamber 16. This reduces the upstream reverse flow of the abrasive G, and prevents the water jet WJ from being disturbed by such reverse flow. Thus, the abrasive G is added into the converged water jet WJ. This produces the highly convergent abrasive water jet AWJ.

The air A reduces the negative pressure in the abrasive supply chamber 16, and accordingly lowers the speed at which the abrasive G is drawn into the abrasive supply chamber 16 through the abrasive inlet hole 7Ac. This greatly reduces the abrasion of the abrasive supply chamber 16 caused by the abrasive G. Further, the abrasive G is added into the water jet WJ while being drawn in at lower speed. This produces the abrasive water jet AWJ containing the water jet WJ and the abrasive G in a uniform manner, and thus reduces the abrasion of the abrasive nozzle flow channel 18 and greatly increases the durability of the abrasive nozzle.

In this manner, the water jet WJ surrounded by the air A, which is the high-speed air stream, is produced. This structure smoothly supplies the appropriate amount of abrasive G from the abrasive supply channel 17, and produces the highly convergent abrasive water jet AWJ containing the water jet WJ and the abrasive G in a uniform manner, thus allowing highly precise cutting of a workpiece.

Modifications

The present invention is not limited to the first and second embodiments, and may be altered and modified variously within the scope of the technical idea. It is intended that the appended claims be interpreted as covering all alterations and modifications as falling within the spirit and scope of the invention.

For example, the orifice 3 and the orifice support 4 described in the first embodiment may be integral with each other.

The air A supplied to the gas inlets 2*c* of the air supply channel 15 may be compressed air that is supplied from an air supply device incorporating an air compressor.

Although the straightening tube 6 in the first embodiment is a tubular member, the straightening tube 6 is not limited to this member. The straightening tube 6 may be any member that has the flow-through channel 13 through which the water jet WJ and the air A can flow, and may have any shape and may be formed from any material. The straightening tube 6 may be, for example, a plate member or a block member having a hole that functions as the flow-through channel 13.

Although the second air supply channel 15*c* of the air supply channel 15 extends from the lateral hole 5*c*, the vertical hole 5*e*, and the lateral groove 5*g* in this order, and communicates with the high-pressure fluid flow channel 14 in the first embodiment, the second air supply channel 15*c* is not limited to this structure. The second air supply channel 15*c* may be any flow channel communicating with a channel that is downstream from the intersection where the air A from the first air supply channel 15*b* meets the water jet WJ (the discharge channel 12). The second air supply channel 15*c* may be defined by, for example, forming a hole communicating with the flow-through channel 13 in the outer circumferential surface of the straightening tube 6 to allow the lateral hole 5*c* to communicate with the flow-through channel 13 through the hole.

Although the nozzle devices 1 and 1A in the first and second embodiments are arranged to have the water jet WJ and the abrasive water jet AWJ discharged vertically downward, the nozzle devices 1 and 1A may be arranged in a manner different from the above manner. The nozzle devices 1 and 1A may be arranged to have the water jet WJ and the abrasive water jet AWJ discharged in a direction other than the vertically downward direction, or for example, in the horizontal direction.

REFERENCE SIGNS LIST

1 nozzle device
3 orifice
4 orifice support
4*c* inner circumferential surface
4*d* downstream peripheral portion
5 branch member
5*a* fitting portion
5*c* lateral hole
5*d*, 5*e* vertical hole
6 straightening tube (straightening unit)
6*a* through-hole
11 liquid supply channel
12 discharge channel
15 air supply channel
15*b* first air supply channel
15*c* second air supply channel
16 abrasive supply chamber
A air (gas)
AWJ abrasive water jet
G abrasive
Q fluid for machining (liquid)
WJ water jet

What is claimed is:

1. A nozzle device, comprising:

a liquid supply channel configured to supply a liquid;

an orifice configured to discharge the liquid supplied from the liquid supply channel to produce a water jet;

a straightening unit arranged downstream of the water jet from the orifice, the straightening unit having a through-hole configured to surround the water jet;

a first air supply channel configured to supply a gas toward a location upstream of the water jet from the through-hole and toward the orifice; and a second air supply channel arranged downstream of the water jet from the first air supply channel, and configured to supply the gas toward a location inside the through-hole or a location downstream of the water jet from the through-hole.

2. The nozzle device according to claim 1, further comprising:

an orifice support arranged downstream of the water jet from the orifice, the orifice support supporting the orifice, wherein the first air supply channel supplies the gas toward the orifice from a location downstream of the water jet from the orifice support.

3. The nozzle device according to claim 2, wherein the orifice support includes a discharge channel configured to allow the water jet to pass through, the discharge channel has a sloping inner circumferential surface that flares downstream of the water jet, and the first air supply channel supplies the gas along the inner circumferential surface.

4. The nozzle device according to claim 2, wherein the orifice support includes a discharge channel configured to allow the water jet to pass through, and the first air supply channel supplies the gas along the inner circumferential surface of the discharge channel.

5. The nozzle device according to claim 3, further comprising:

a branch member arranged downstream of the water jet from the orifice support, the branch member including an air supply channel that branches into the first air supply channel and the second air supply channel.

6. The nozzle device according to claim 5, wherein the straightening unit is a cylindrical straightening tube, the straightening tube is supported by the branch member and includes an upper portion protruding from the branch member, the upper portion is arranged adjacent to the inner circumferential surface of the discharge channel, and the first air supply channel supplies the gas from a clearance between the inner circumferential surface of the discharge channel and the upper portion of the straightening tube.

7. The nozzle device according to claim 1, further comprising:

a high-pressure fluid flow channel arranged downstream of the water jet from the straightening unit, the high-pressure fluid flow channel having an inner diameter greater than an inner diameter of the through-hole.

8. The nozzle device according to claim 1, wherein the water jet is discharged vertically downward.

9. The nozzle device according to claim 1, further comprising:

an abrasive supply chamber arranged under the second air supply channel, the abrasive supply chamber being configured to add an abrasive into the water jet to produce an abrasive water jet.

10. The nozzle device according to claim 4, further comprising:

a branch member arranged downstream of the water jet from the orifice support, the branch member including an air supply channel that branches into the first air supply channel and the second air supply channel.

11. The nozzle device according to claim 10, wherein the straightening unit is a cylindrical straightening tube, the straightening tube is supported by the branch member and includes an upper portion protruding from the branch member, the upper portion is arranged adjacent to the inner circumferential surface of the discharge channel, and the first air supply channel supplies the gas from a clearance between the inner circumferential surface of the discharge channel and the upper portion of the straightening tube.

12. The nozzle device according to claim 2, further comprising:

a high-pressure fluid flow channel arranged downstream of the water jet from the straightening unit, the high-pressure fluid flow channel having an inner diameter greater than an inner diameter of the through-hole.

13. The nozzle device according to claim 3, further comprising:

a high-pressure fluid flow channel arranged downstream of the water jet from the straightening unit, the high-pressure fluid flow channel having an inner diameter greater than an inner diameter of the through-hole.

14. The nozzle device according to claim 4, further comprising:

a high-pressure fluid flow channel arranged downstream of the water jet from the straightening unit, the high-pressure fluid flow channel having an inner diameter greater than an inner diameter of the through-hole.

15. The nozzle device according to claim 2, wherein the water jet is discharged vertically downward.

16. The nozzle device according to claim 3, wherein the water jet is discharged vertically downward.

17. The nozzle device according to claim 4, wherein the water jet is discharged vertically downward.

18. The nozzle device according to claim 2, further comprising:

an abrasive supply chamber arranged under the second air supply channel, the abrasive supply chamber being configured to add an abrasive into the water jet to produce an abrasive water jet.

19. The nozzle device according to claim 3, further comprising:

an abrasive supply chamber arranged under the second air supply channel, the abrasive supply chamber being configured to add an abrasive into the water jet to produce an abrasive water jet.

20. The nozzle device according to claim 4, further comprising:

an abrasive supply chamber arranged under the second air supply channel, the abrasive supply chamber being configured to add an abrasive into the water jet to produce an abrasive water jet.

* * * * *